US010241461B2

(12) United States Patent
Nakachi

(10) Patent No.: US 10,241,461 B2
(45) Date of Patent: Mar. 26, 2019

(54) IMAGE FORMING APPARATUS FOR FORMING IMAGES ON MEDIA USING DEVELOPER THAT INCLUDES TONER

(71) Applicant: KYOCERA Document Solutions Inc., Osaka (JP)

(72) Inventor: Kazuhiro Nakachi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/952,517

(22) Filed: Apr. 13, 2018

(65) Prior Publication Data

US 2018/0373194 A1 Dec. 27, 2018

(30) Foreign Application Priority Data

Jun. 22, 2017 (JP) ..... 2017-122039

(51) Int. Cl.
*G03G 15/00* (2006.01)
*G03G 21/00* (2006.01)

(52) U.S. Cl.
CPC ..... *G03G 21/0052* (2013.01); *G03G 15/5016* (2013.01); *G03G 2221/0042* (2013.01); *G03G 2221/0063* (2013.01)

(58) Field of Classification Search
CPC .... G03G 15/50; G03G 15/5016; G03G 21/00; G03G 21/0052; G03G 21/206; G03G 2221/0005; G03G 2221/0021; G03G 2221/0026; G03G 2221/0042; G03G 2221/0063
See application file for complete search history.

(56) References Cited

U.S. PATENT DOCUMENTS 5,428,379 A * 6/1995 Kaneko ..... G03G 15/50 347/17
5,923,922 A 7/1999 Ishida et al.
9,678,472 B2 * 6/2017 Kinoshita ..... G03G 21/206
2003/0142992 A1 * 7/2003 Johnson ..... G03G 21/206 399/93

FOREIGN PATENT DOCUMENTS

JP H08-328435 A 12/1996
JP 4070482 B2 * 4/2008

* cited by examiner

*Primary Examiner* — Sophia S Chen
(74) *Attorney, Agent, or Firm* — Hawaii Patent Services; Nathaniel K. Fedde; Kenton N. Fedde

(57) ABSTRACT

Provided is an inexpensive image forming apparatus capable of monitoring the generating state of various powders. The image forming apparatus includes a minute-particle-measuring device, a toner-particles-detecting air duct, a paper-dust-detecting air duct, and blower fans. The minute-particle-measuring device detects the concentration of minute particles in air. The toner-particle-detecting air duct is an air duct leading from the image forming unit to the minute-particle-measuring device. The paper-dust-detecting air duct is an air duct leading from the paper-conveying path to the minute-particle-measuring device. The blower fans are respectively provided in the toner-particle-detecting air duct and the paper-dust-detecting air duct, and generate airflow that flows toward the minute-particle-measuring device side. The blower fans in the toner-particle-detecting air duct and in the paper-dust-detecting air duct are switched.

7 Claims, 3 Drawing Sheets

IMAGE FORMING APPARATUS FOR FORMING IMAGES ON MEDIA USING DEVELOPER THAT INCLUDES TONER

INCORPORATION BY REFERENCE

This application is based on and claims the benefit of priority from Japanese Patent Application No. 2017-122039 filed on Jun. 22, 2017, the contents of which are hereby incorporated by reference.

BACKGROUND

The present disclosure relates to an image forming apparatus for forming images on media using developer that includes toner.

In an image forming apparatus such as a printer and the like, an image pattern that is composed of toner is fixed on paper (medium) and outputted. When doing this, a developer is used in which toner particles formed of a resin material or the like as a dye that will be a toner component, and carrier particles (carrier) that are made of magnetic material and that are larger than the toner particles are mixed in a powder state, and an electric charge is applied to the toner particles. On the other hand, an electric potential distribution that corresponds to an image pattern to be formed is applied to a photosensitive drum, and a magnetic field is applied to a developing roller. By supplying developer between the photosensitive drum and the developing roller, carrier particles adhere to the developing roller, and an image pattern composed of toner particles is formed on the photosensitive drum. After the toner pattern on this photosensitive drum is transferred to paper, the toner pattern is fixed to the paper by heating the toner image by a fixing heating roller, and an image is formed.

Here, after this operation is repeated, toner particles in the developer may become scattered inside the apparatus. In such a case, the scattered toner particles may adhere to the paper separately from the image pattern described above, causing defects in the outputted image. Therefore, there is a need to suppress this kind of scattering of toner particles inside the apparatus, and in a typical image forming apparatus, in order to achieve this, a particle counter (minute particle measuring device) is provided inside the apparatus, and with this particle counter, the concentration of the toner particles that are scattered in air is measured. When it is determined that this concentration is high, an operation for suppressing the scattering of toner particles can be automatically performed. As a result, it is possible to perform the operation of the image forming apparatus while suppressing the scattering of toner particles. Alternatively, it is possible to issue a warning to a user and to cause a user to perform maintenance.

SUMMARY

The image forming apparatus according to the present disclosure is an image forming apparatus that includes an image forming unit for forming an image pattern using toner that is configured with toner powder, and a paper-conveying path for conveying paper to a location where the image pattern is transferred to the paper. The image forming apparatus includes a minute-particle-measuring device, a toner-particle-detecting air duct, a paper-dust-detecting air duct, and blower fans. The minute-particle-measuring device detects the concentration of minute particles in air. The toner-particle-detecting air duct is an air duct leading from the image forming unit to the minute-particle-measuring device. The paper-dust-detecting air duct is an air duct leading from the paper-conveying path to the minute-particle-measuring device. The blower fans are respectively provided in the toner-particle-detecting air duct and the paper-dust-detecting air duct, and generate airflow that flows toward the minute-particle-measuring device side. The image forming apparatus is set so the blower fans in the toner-particle-detecting air duct and in the paper-dust-detecting air duct operate by being switched.

The image forming apparatus according to the present disclosure is an image forming apparatus that includes plural image forming units for forming respective image patterns using plural types of toner that are configured with toner powder that differs from each other, and a paper-conveying path for conveying paper to locations where the image patterns are transferred to the paper. The image forming apparatus includes a minute-particle-measuring device, plural toner-particle-detecting air ducts, and blower fans. The minute-particle-measuring device detects the concentration of minute particles in air. The plural toner-particle-detecting air ducts are air ducts leading from the respective plural image forming units to the minute-particle-measuring device. The blower fans are respectively provided in the plural toner-particle-detecting air ducts, and generate airflow that flows toward the minute-particle-measuring device side. The image forming apparatus is set so the blower fans in the respective plural toner-particle-detecting air ducts are operated by being switched.

DETAILED DESCRIPTION

Figure 1:
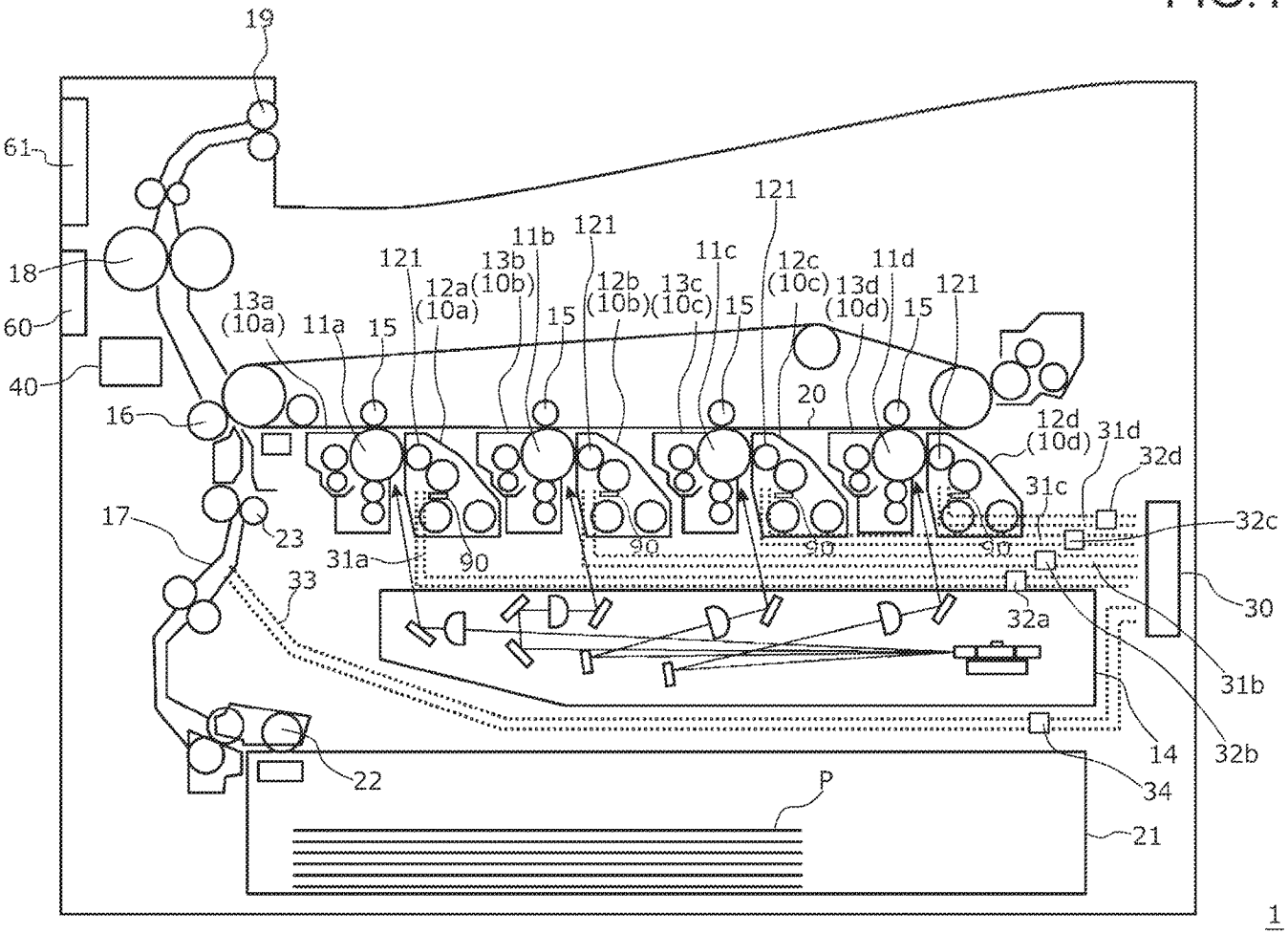
FIG. 1 is a diagram illustrating the configuration of an image forming apparatus of an embodiment according to the present disclosure.

In the following, embodiments according to the present disclosure will be explained with reference to the drawings. FIG. 1 is a diagram illustrating configuration of an image forming apparatus 1 of an embodiment according to the present disclosure. Here, four image forming units 10*a*, 10*b*, 10*c* and 10*d* that respectively correspond to C (cyan), M (magenta), Y (yellow), K (black) color image data are arranged in the horizontal direction in FIG. 1. An intermediate-transfer belt 20 is provided adjacent to the upper portions of the four image forming units 10*a*, 10*b*, 10*c* and 10*d*. Each image forming unit 10*a*, 10*b*, 10*c*, 10*d* is provided in order to form a toner pattern corresponding to the respective color above-mentioned on the surface of the respective photosensitive drum 11*a*, 11*b*, 11*c*, 11*d*. Therefore, developing units 12*a*, 12*b*, 12*c*, 12*d* that respectively expose the photosensitive drums 11*a* to 11*d* to developer that includes each of the colors of toner above-mentioned are provided in the image forming units 10*a* to 10*d*, respectively. Moreover, charging units 13*a*, 13*b*, 13*c*, 13*d* for charging or cleaning the respective photosensitive drums 11*a*, 11*b*, 11*c*, 11*d* are provided in the image forming units 10*a* to 10*d*, respectively.

Moreover, the charged states of the surfaces of the photosensitive drums 11*a* to 11*d* are performed so as to correspond to image patterns corresponding to C, M, Y, and K, respectively, so by electrostatic force, toner (toner particles) adheres to the surfaces of the photosensitive drums 11*a* to 11*d* in the image patterns. In order to form the charged patterns (latent images) on the photosensitive drums 11*a* to 11*d*, an exposing unit 14 performs exposure of the each of the photosensitive drums 11*a* to 11*d* after being charged for each C, M, Y and K above-mentioned. As a result, latent images that correspond to the image patterns for each color above-mentioned are formed on each of the photosensitive drums 11*a* to 11*d*.

In the developing unit 12*a* to 12*d*, toners corresponding to each of the respective colors C, M, Y, K are used. The toner particles that make up each of the toners are used independently by each developing unit 12*a* to 12*d* as developers mixed with carrier particles (carriers) that are composed of magnetic material. Magnetic fields are applied to the developing rollers 121 in the developing units 12*a* to 12*d*. In each of the image forming units 10*a*, 10*b*, 10*c*, 10*d*, the respective developers are supplied between the photosensitive drums 11*a* to 11*d* to which electric potential distributions are applied and the developing rollers 121. When doing this, carrier particles adhere to the developing rollers 121, and toner particles adhere to the surfaces of the photosensitive drums 11*a* to 11*d* according to the electric potential distributions that are applied to the photosensitive drums 11*a* to 11*d*. As a result, image patterns that are composed of each of the toner types are formed on the photosensitive drums 11*a* to 11*d*.

The image patterns on each of the photosensitive drums 11*a* to 11*d* are transferred to an intermediate-transfer belt 20 as the intermediate-transfer belt 20 that is sandwiched between each of the photosensitive drums 11*a* to 11*d* and primary-transfer rollers 15 that are provided above each of the photosensitive drums 11*a* to 11*d* moves.

On the other hand, a large number of sheets of paper P are stacked and stored in a paper cassette 21 that is provided in the lower portion of the image forming apparatus 1. The paper P is conveyed to the secondary-transfer roller 16 side via the paper-supply roller 22 and resist roller 23, and a path from the paper-supply roller 22 to the secondary-transfer roller 16 forms a paper-conveying path 17 that conveys the paper P before the toner image is formed. After passing this paper-conveying path 17, the paper P is sandwiched and conveyed between the intermediate-transfer belt 20 to which the image patterns are transferred and the secondary-transfer roller 16, and during this time each of the image patterns are transferred to the paper P. After that, the paper P is heated by the upper fixing roller 18, which fixes each of the image patterns composed of each of the toner types, then the paper P is discharged to the outside by the discharge roller 19.

The configuration described above is the same as that in a generally known color printer. Here, in order to form a good image on paper P, it is necessary in the configuration described above to suppress dust from adhering to the paper P. Particularly, when dust adheres to the paper P while the paper P is conveyed from the paper-supply cassette 21 to the fixing roller 18, the dust is fixed to the paper P together with the image and becomes defects in the image.

In the configuration described above, the cause of such dust is the various toner particles that are handled by each of the image forming units 10*a* to 10*d* (developing units 12*a* to 12*d*), and paper dust that is generated when the paper P is conveyed from the paper-supply cassette 21.

Therefore, a particle counter (minute particle measuring device) 30 is provided in this image forming apparatus 1 in order to maintain the existing concentration in the air of these kinds of toner particles and paper dust. In FIG. 1, the generating sources of the toner particles are the image forming units 10*a*, 10*b*, 10*c*, 10*d*, and the generating source of the paper dust is the region that extends in the vertical direction from the paper-supply cassette 21 to the fixing roller 18. Therefore, the particle counter 30 detects without distinction the four types of toner particles and paper dust that are scattered and floating in the air as minute particles.

Tubular toner-particle-detecting air ducts (air ducts) 31*a*, 31*b*, 31*c*, 31*d* that are flow paths for air are respectively provided between the particle counter 30 and the image forming units 10*a*, 10*b*, 10*c*, 10*d*. Blower fans 32*a*, 32*b*, 32*c*, 32*d* are provided in the toner-particle-detecting air ducts 31*a*, 31*b*, 31*c*, 31*d*, respectively. Moreover, similarly a tubular paper-dust-detecting air duct (air duct) 33 that is a flow path for air is provided between the particle counter 30 and the paper-conveying path 17, and a blower fan 34 is also provided in the paper-dust-detecting air duct 33. When the blower fans 32*a*, 32*b*, 32*c*, 32*d*, 34 are turned ON, the air is set to flow toward the particle counter 30 side in both the toner-particle-detecting air ducts 31*a*, 31*b*, 31*c*, 31*d* and paper-dust-detecting air duct 33.

Moreover, a control unit 40 that is a CPU for performing control for forming images on paper P by controlling the image forming units 10*a*, 10*b*, 10*c*, 10*d* and the movement of each of the rollers described above is provided in the image forming apparatus 1. Furthermore, an operation panel 60 that is used by the user for operating the image forming apparatus 1, and a display unit (display) 61 that displays various information and warnings of the image forming apparatus 1, and that is used by the user when operating the operation panel 60 are provided. In FIG. 1, the image forming apparatus 1 is set for the user to operate the operation panel 60 from the left side in the figure, and the display unit 61 is provided close to and on the same side as the operation panel 60. A touch panel in which the operation panel 60 and the display unit 61 are integrated may also be used. Moreover, in this image forming apparatus 1, the particle counter 30 is provided on the opposite side from the operation panel 60 and the display unit 61 (right side in FIG. 1).

The control unit 40 performs control of the detection operation by the particle counter 30, and control for turning ON and OFF the blower fans 32*a*, 32*b*, 32*c*, 32*d*, 34 in conjunction with each other. Here, when turning ON the blower fans 32*a*, 32*b*, 32*c*, 32*d*, 34, the control unit 40 may select and turn ON only one of these. When any one of the blower fans 32*a*, 32*b*, 32*c*, 32*d*, 34 is turned ON, the minute particle concentration in the air of one of the toner-particle-detecting air ducts 31*a*, 31*b*, 31*c*, 31*d* and paper-dust-detecting air duct 33 is measured by the particle counter 30. When the blower fans 32*a*, 32*b*, 32*c*, 32*d*, 34 are turned ON, the minute particles that are detected by the particle counter 30 can be presumed to be generated in the respective image forming units 10*a*, 10*b*, 10*c*, 10*d* and the paper-conveying path 17. The minute particles generated by the image forming units 10*a*, 10*b*, 10*c*, 10*d* can be presumed to be toner particles of the respective C (cyan), M (magenta), Y (yellow) and K (black) toners, and the minute particles that are generated in the paper-conveying path 17 can be presumed to be paper dust.

Figure 2:
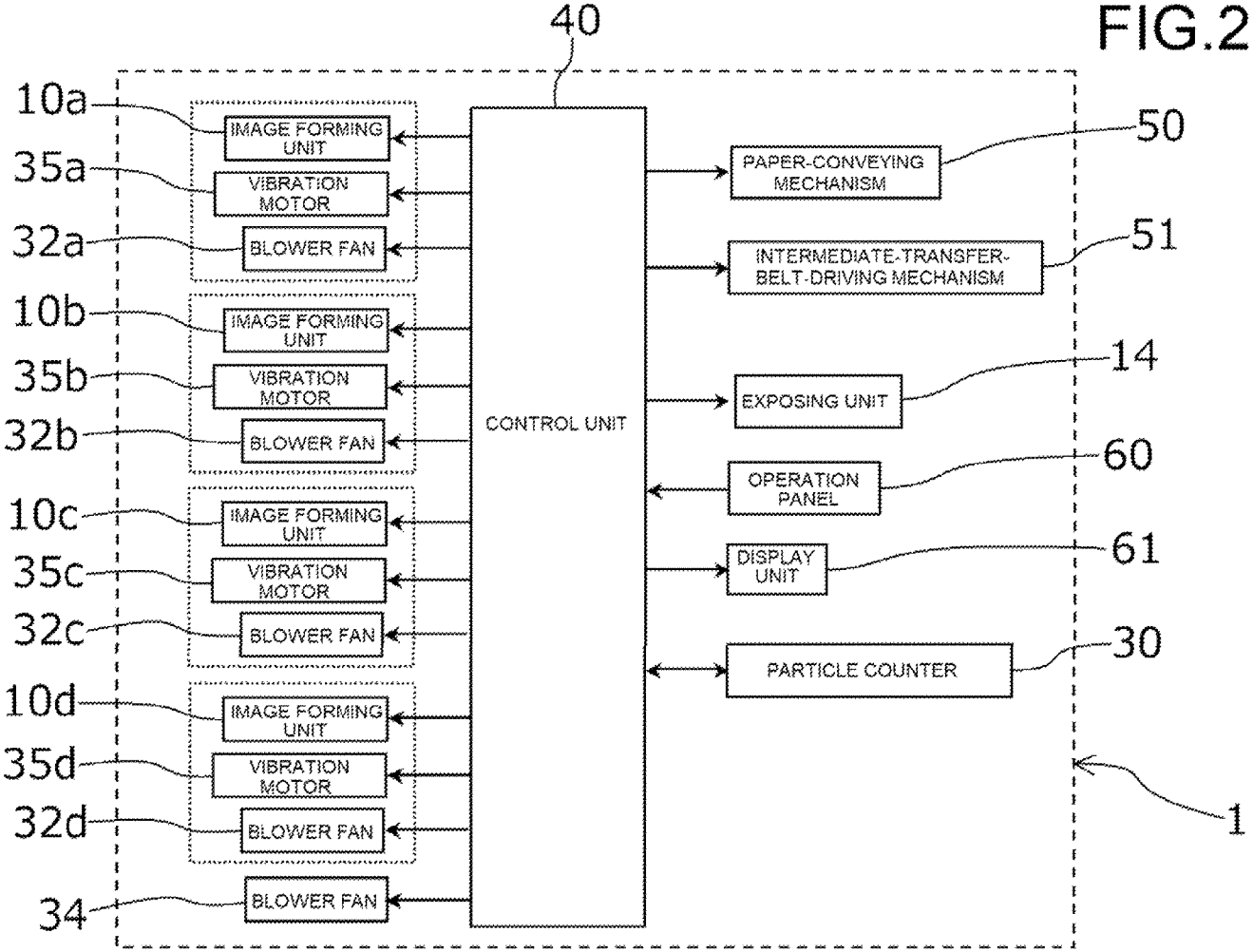
FIG. 2 is a block diagram illustrating configuration related to control of an image forming apparatus of an embodiment according to the present disclosure.

FIG. 2 is a block diagram illustrating the relationship between the control unit 40 and each component that is controlled by the control unit 40. Here, the paper-conveying mechanism 50 includes the paper-supply roller 22, the resist roller 23, the secondary-transfer roller 16, the fixing roller 18, and the like in FIG. 1, and is a mechanism for conveying paper P, and the intermediate-transfer belt-driving mechanism 51 is a mechanism for driving the intermediate-transfer belt 20.

In FIG. 2, blower fans 32*a*, 32*b*, 32*c*, 32*d* are respectively provided to correspond to the image forming units 10*a*, 10*b*, 10*c*, 10*d*, and a blower fan 34 in the paper-dust-detecting air duct 33 is provided separate from these. Moreover, driving motors 35*a*, 35*b*, 35*c*, 35*d* described later are respectively provided to correspond to the image forming units 10*a*, 10*b*, 10*c*, 10*d*.

With the configuration described above, the control unit 40 can monitor the scattered amount of each of the toner particles and the paper dust that are generated mainly at spaced locations using a single particle counter 30. This becomes possible by selecting and turning ON one of the blower fans 32*a*, 32*b*, 32*c*, 32*d*, 34. Therefore, the detection results can be transmitted to the user via the display unit 61, and after checking the detection results, the user can perform maintenance (cleaning and the like) of the image forming apparatus 1. Moreover, as illustrated in FIG. 1, the particle counter 30 is provided on a different side than the operation panel 60 that is operated by the user, so dust that is emitted from the user side and that effects the measurement above-mentioned is also suppressed.

Alternatively, when it is recognized in particular that a lot of toner particles are generated in the image forming units 10*a*, 10*b*, 10*c*, 10*d*, measures can be taken for suppressing the occurrence of defects in images in the image forming units 10*a*, 10*b*, 10*c*, 10*d*. As a mechanism for performing such measures, there is, for example, the vibration motor of a typical image forming apparatus. In this image forming apparatus, a plate-shaped toner-receiving member 90 is provide in the vicinity of and below the developing roller and toner-supply roller that are used in an image forming unit. The toner-receiving member can suppress toner particles from being scattered as minute particles near the image forming unit by receiving toner (toner particles) that drops from the developing roller and the like. A vibration motor is connected to this toner-receiving member and causes the toner-receiving member to vibrate.

In this configuration, by driving the vibration motor when a substantial amount of toner particles have accumulated in the toner-receiving member, the toner layer that is accumulated in the toner-receiving member is shaken off. When doing this, by shaking off the toner particles as a solidified toner layer instead of as minute particles, the toner particles do not become an image defect. At this time, the toner that is shaken off can be guided to a specified location on the lower side, so maintenance of the image forming apparatus also becomes easy.

This kind of toner-receiving member and vibration motors 35*a*, 35*b*, 35*c*, 35*d* correspond to the image forming units 10*a*, 10*b*, 10*c*, 10*d* and are provided to correspond to each of the image forming units 10*a*, 10*b*, 10*c*, 10*d*. In this case, when the concentration of toner particles in any one of the image forming units 10*a*, 10*b*, 10*c*, 10*d* as above configured becomes high, the control unit 40 can determine that toner particles have thickly accumulated in the toner-receiving member of that image forming unit. Moreover, the control unit 40 can drive one of the corresponding vibration motors 35*a*, 35*b*, 35*c*, 35*d*. As a result, maintenance of the image forming unit can be simplified while also suppressing image defects.

However, the state of accumulating toner particles and peeling due to the shaking in a toner-receiving member such as described above differs depending on the characteristics of the toner particles used. For example, when it is difficult for accumulated toner particles to solidify in the toner-receiving member and the vibration motor vibrates the toner-receiving member, contrary to that described above, scattering of the toner particles into the air may become more severe. In such a case, it is possible to drive one of the corresponding vibration motors 35*a*, 35*b*, 35*c*, 35*d* in the one selected image forming unit 10*a*, 10*b*, 10*c*, 10*d*. At the same time as this, it is also possible to drive one of the corresponding blower fans 32*a*, 32*b*, 32*c*, 32*d*. In this case, the toner particles that are scattered from the toner-receiving member in the selected image forming unit are detected by the particle counter 30. In this case, when the concentration of minute particles detected exceeds a threshold value, the control unit 40 may issue a warning that toner particles have already accumulated and there is a possibility that contamination will occur. As a result, the user can perform maintenance (cleaning or the like) of the image forming apparatus 1.

When a toner-receiving member and vibration motor are used in each image forming unit, determining which of the operations above-mentioned to perform can be appropriately selected according to the toner (toner particles) used, the configuration in the image forming units of the developing rollers, toner-supply rollers, and the like.

Figure 3:
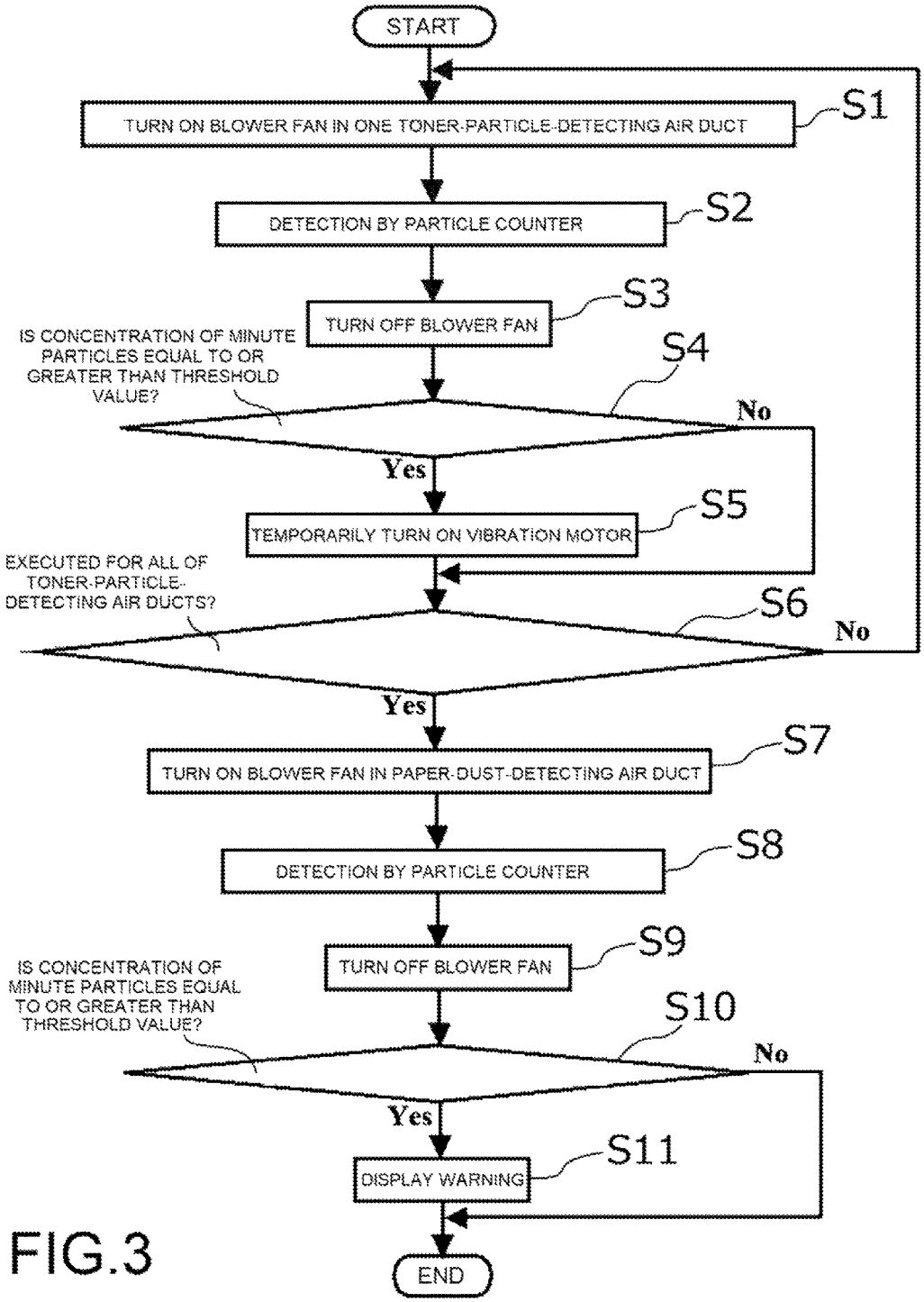
FIG. 3 is a flowchart illustrating an example of operation of an image forming apparatus of an embodiment according to the present disclosure.

FIG. 3 is an example of a flowchart illustrating the control operation by the control unit 40 in this image forming apparatus 1. As described above, the control in the image forming units 10*a*, 10*b*, 10*c*, 10*d* according to the detection results by the particle counter 30 is set according to the toner type and the like. However, here, it is presumed that in order to remove the toner layer that is accumulated in the toner-receiving member when the concentration of toner particles is high, a vibration motor is driven. In addition, it is presumed that when there is a large amount of paper dust in the paper-conveying path 17, a warning is issued.

Here, first, one of the image forming units 10*a*, 10*b*, 10*c*, 10*d* (toner-particle-detecting air ducts 31*a*, 31*b*, 31*c*, 31*d*) is selected, and one of the corresponding blower fans 32*a*, 32*b*, 32*c*, 32*d* is driven (S1). After that, after the concentration of minute particles is detected by the particle counter 30 (S2), the blower fan is turned OFF (S3). Here, the detected minute particles are presumed to be toner powder that is used in the selected image forming unit. When the concentration of minute particles detected here is equal to or greater than a preset threshold concentration (S4: YES), as described above, the vibration motor in the image forming unit is driven temporarily (S5), and the operation related to the image forming unit ends. When the concentration of the minute particles is less than the threshold concentration, it is considered that there is no particular problem related to the scattering of toner particles in the corresponding image forming unit, so operation related to the selected image forming unit ends without driving the vibration motor. Incidentally, in either case, the detection results by the particle counter 30 are displayed by the display unit 61. The operation described above is performed separately for all of the image forming units 10*a*, 10*b*, 10*c*, 10*d*, and after the operation is performed for all of the image forming units (S6: YES), the operation performed related to the scattering of toner powder ends.

After that, an operation for scattering of paper dust is performed. In order for this, the blower fan 34 in the paper-dust-detecting air duct 33 is turned ON (S7), and after the concentration of minute particles is detected by the particle counter 30 (S8), the blower fan 34 is turned OFF (S9). Here, the detected minute particles are presumed to be paper dust. When the concentration of minute particles detected here is equal to or greater than a preset threshold concentration (S10: YES), as described above, a warning advising that maintenance be performed due to the large amount of paper dust is displayed by the display unit 61 (S11), and the operation related to the scattering of paper dust ends. When the concentration of minute particles is less than the threshold concentration, it is considered that there is no particular problem related to the scattering of paper dust in the paper-conveying path 17, so the operation related to the scattering of paper dust ends without issuing a warning.

Incidentally, instead of driving a vibration motor (S5) such as described above, a warning indicating that that toner particles are greatly scattered in the corresponding image forming unit (developing unit) may be issued on the display unit 61. In other words, when it is recognized that the scattering of toner particles is severe, various countermeasures are possible. Moreover, in this case, as described above, a setting is possible such that when a blower fan that corresponds to a respective image forming apparatus is turned ON, the vibration motor is temporarily driven.

In addition, in the image forming apparatus 1 described above, in order to handle color images, four types of independent image forming units 10*a*, 10*b*, 10*c*, 10*d* are used. However, the image forming apparatus may correspond to only monochrome images, and may be an image forming apparatus in which only one type of image forming unit that uses only one type of toner is used. In this case, in order to correspond to the effect of both the scattering of toner particles and the scattering of paper dust in the paper-conveying path, one toner-particle-detecting air duct such as described above may be provided. In addition, it is also effective to similarly provide a paper-dust-detecting air duct as described above, and to use a single particle counter as described above.

Alternatively, evaluation related to the scattering of toner particles may be performed for two or more types of toner particles without performing evaluation related to the scattering of paper dust. In this case as well, two or more types of toner-particle-detecting air ducts such as described above may be provided to correspond to the toner types. Moreover, using a single particle counter as described is effective. Furthermore, in addition to the configuration illustrated in FIG. 1, the configuration described above is effective as long as the image forming apparatus uses toner powder.

Incidentally, in an image forming apparatus that can perform color output, plural types of toner corresponding to plural types of (for example, four types) of colors are used. Photosensitive drums are provided to correspond to each type of toner, and developing apparatuses for forming image patterns on each photosensitive drum for each color are provided for each color. Image patterns corresponding to each respective color (each toner type) are transferred to one sheet of paper from each photosensitive drum.

At this time, scattering of toner particles occurs independently at different locations for each toner type, and control according to the concentration of toner particles must be performed for each developing apparatus. In order to do this, it is necessary to provide a particle counter for each toner type.

Moreover, besides toner particles such as described above as the particles that are generated inside the image forming apparatus, there is also paper dust that is generated from part of the paper when the paper is being conveyed, for example. The concentration of paper dust in air can also be measured by the same particle counter as described above. However, the locations where paper dust is generated are further different than the locations described above where toner particles are generated, so in order to monitor paper dust, a separate particle counter is further necessary.

Therefore, in order to monitor the state of the generation of various powders inside the image forming apparatus, and perform control according to that generation state, it becomes necessary to have many particle counters, and so the configuration of the image forming apparatus becomes complicated and the image forming apparatus becomes expensive. Therefore, there is a demand for an inexpensive image forming apparatus that is capable of monitoring the generation state of various powders.

With the configuration according to the present disclosure described above, it is possible to obtain an inexpensive image forming apparatus that is capable of monitoring the generation state of various powders.

What is claimed is:

1. An image forming apparatus comprising an image forming unit for forming an image pattern using toner that is configured with toner powder, and a paper-conveying path for conveying paper to a location where the image pattern is transferred to the paper; and further comprising:

a minute-particle-measuring device for detecting a concentration of minute particles in air;

a toner-particle-detecting air duct as an air duct leading from the image forming unit to the minute-particle-measuring device;

a paper-dust-detecting air duct as an air duct leading from the paper-conveying path to the minute-particle-measuring device; and blower fans that are respectively provided in the toner-particle-detecting air duct and the paper-dust-detecting air duct, and that generate air flow that flows toward a minute-particle-measuring device side; wherein the blower fans in the toner-particle-detecting air duct and in the paper-dust-detecting air duct are set to operate by being switched.

2. The image forming apparatus according to claim 1, wherein plural types of the toner are used, an image forming unit and a toner-particle-detecting air duct are provided for each of the types, and a respective blower fan is provided in each of the toner-particle-detecting air ducts; and the respective blower fans are set to operate by being switched.

3. The image forming apparatus according to claim 1, wherein a warning is issued to a user according to detection results of the minute-particle-measuring device.

4. The image forming apparatus according to claim 1, wherein a plate-shaped toner-receiving member for receiving dropped toner powder, and a vibration motor for vibrating the toner-receiving member are provided in the image forming unit.

5. The image forming apparatus according to claim 4, wherein the vibration motor is configured to be driven according to detection results of the minute-particle-measuring device.

6. The image forming apparatus according to claim 4, wherein the blower fans in the image forming unit are driven in a state in which the vibration motor in the image forming unit is driven.

7. An image forming apparatus comprising plural image forming units for forming respective image patterns using plural types of toner that are configured with toner powder that differs from each other, and a paper-conveying path for conveying paper to locations where the image patterns are transferred to the paper; and further comprising:

a minute-particle-measuring device for detecting a concentration of minute particles in air;

plural toner-particle-detecting air ducts as air ducts leading from the respective plural image forming units to the minute-particle-measuring device; and blower fans that are respectively provided in the plural toner-particle-detecting air ducts, and that generate air flow that flows toward a minute-particle-measuring device side; wherein the blower fans in the respective plural toner-particle-detecting air ducts are set to operate by being switched.

* * * * *